US006767290B1

(12) United States Patent
Tan

(10) Patent No.: US 6,767,290 B1
(45) Date of Patent: Jul. 27, 2004

(54) GOLF TRAINING AID

(76) Inventor: Christopher K. Tan, 54922 Southern Hills, La Quinta, CA (US) 92253

( * ) Notice: Subject to any disclaimer, the term of this patent is extended or adjusted under 35 U.S.C. 154(b) by 0 days.

(21) Appl. No.: 10/377,043

(22) Filed: Feb. 28, 2003

(51) Int. Cl.[7] ..... A63B 69/36

(52) U.S. Cl. ..... 473/212; 473/207; 473/409; 602/4

(58) Field of Search ..... 473/212, 215, 473/216, 227, 207, 266, 275, 276, 277; 224/257, 258

(56) References Cited

U.S. PATENT DOCUMENTS

| | | | | | |
|---|---|---|---|---|---|
| 475,432 | A | * | 5/1892 | Blades | 473/415 |
| 2,093,153 | A | * | 9/1937 | McCarthy | 473/212 |
| 2,808,267 | A | * | 10/1957 | Heaton | 473/212 |
| 3,679,214 | A | * | 7/1972 | Boyte | 473/212 |
| 3,740,052 | A | * | 6/1973 | Arkin | 473/214 |
| 4,061,340 | A | * | 12/1977 | Husted | 473/212 |
| 4,359,221 | A | * | 11/1982 | Taylor | 473/63 |
| 4,598,703 | A | * | 7/1986 | Lindemann | 602/4 |
| 4,691,924 | A | * | 9/1987 | Strong | 473/212 |
| 4,844,306 | A | * | 7/1989 | Ruff et al. | 224/600 |
| 4,890,841 | A | * | 1/1990 | Brooks | 473/212 |
| 4,892,317 | A | * | 1/1990 | Corder, Jr. | 473/212 |
| 5,188,365 | A | * | 2/1993 | Picard | 473/213 |
| 5,203,763 | A | * | 4/1993 | Lajiness-O'Neill | 602/4 |
| 5,335,835 | A | * | 8/1994 | Hogan | 224/257 |
| 5,451,060 | A | * | 9/1995 | Dalbo | 473/215 |
| 5,704,856 | A | * | 1/1998 | Morse | 473/422 |
| 5,951,408 | A | * | 9/1999 | Inman | 473/212 |
| 6,126,554 | A | * | 10/2000 | Poscente | 473/212 |
| 6,129,638 | A | * | 10/2000 | Davis | 473/215 |

OTHER PUBLICATIONS

Armaster, http://www.dwquailgolf.com/training/armmaster.html (Oct. 15, 2002) [1 page].
SwingLink–David Leadbetter, http://www.onlinesports.com/pages/I,BK–7441STD.html (Oct. 15, 2002) [2 pages].
Figure 8 Strap/Smooth Swing, http://www.dwquailgolf.com/training/figure8_strap.html (Oct. 15, 2002) [1 page].
Swingmaker, http://theswingmaker.com/ (Oct. 28, 2002) [6 pages].
Right Angle2, http://dwquailgolf.com/training/right_angle2.html (Oct. 15, 2002) [2 pages].
EZ Plane Golf Training System, http://www.dwquailgolf.com/training/plane_ez.html (Oct. 15, 2002) [3 pages].
Swing Jacket, http://dwquailgolf.com/training/swing_jacket.html (Oct. 15, 2002) [5 pages].

* cited by examiner

*Primary Examiner*—Stephen P. Garbe
*Assistant Examiner*—Nini F. Legesse
(74) *Attorney, Agent, or Firm*—Cohen Sakaguchi & English LLP

(57) ABSTRACT

A golf training aid for developing a golf swing of a golfer is described. The golf training aid has a shoulder strap adapted to be worn by the golfer around the shoulder of one arm, and an elbow member adapted to be worn above the elbow of the opposite arm. When worm a portion of the shoulder strap passes in front of the golfer where a coupling structure couples the shoulder strap to the elbow member such that the arms are positioned in front of the golfer's body. The golf training aid is adapted to maintain a substantially constant distance between the shoulder and the opposite elbow of the golfer during a golf swing, thus facilitating synchronization of proper arm position with rotation of the body throughout the golf swing. Typically, the shoulder strap and elbow member are adjustable, and the coupling structure permits decoupling of the shoulder strap from the elbow member to promote efficient use of the present invention.

8 Claims, 7 Drawing Sheets

GOLF TRAINING AID

FIELD OF INVENTION

The present invention relates generally to a golf training device. More particularly, the present invention relates to a golf training aid that is adapted to maintain a substantially constant distance between the shoulder and elbow of opposite arms during a golf swing.

INCORPORATION BY REFERENCE

The contents of each U.S. patent or other reference, if any, cited in this application, are hereby incorporated herein by reference.

BACKGROUND OF INVENTION

Golf is a very popular game used as a source of recreation, exercise, and social engagement by people of all ages and skill levels. Anyone who has attempted to hit a golf ball realizes that it is not an easy endeavor. Typically, to improve or become proficient in the game it is necessary for the golfer to develop a precise, accurate, and consistent golf swing such that upon hitting the golf ball the ball is directed in the general direction of the hole. Numerous devices and methods have been developed in an attempt to improve various aspects of the golfer's game.

Due to a large number of variables such as hand-eye coordination, body positioning, and swing mechanics involved in hitting a golf ball, typically a golf swing is very difficult to master. One of the best ways to build a stronger and more consistent golf game is by focusing the golfer's energy on a specific component rather than attempting to fix everything at once. Improvement in swing mechanics is one specific component in which "muscle memory" is of particular importance. If the body can feel the proper golf swing positions on a more consistent basis, eventually the body adapts and the correct golf swing positions become more natural and instinctive, i.e., muscle memory is promoted. Allowing the body to feel the proper golf swing positions often involves placing the golfer's body into a proper swing position corresponding to some golf skill, and restraining the golfer's body in such a position during which time the golfer practices the required golf skill.

With reference to a right-handed golfer, one such golf skill requires the golfer to keep the right arm/elbow in front of the body during a "full golf swing" thus preventing the right arm from "lagging" behind the body. Synchronization of proper arm position, i.e., maintaining the relationship or distance between the left shoulder and the right elbow, with rotation of the body throughout the golf swing, is a fundamental skill that generally helps improve distance, accuracy, and consistency.

Accordingly, there is a need for a golf training aid adapted to maintain a substantially constant distance between the shoulder and elbow of opposite arms during a golf swing that is simple and effective in promoting "muscle memory" and is more efficient than known devices.

SUMMARY OF INVENTION

A golf training aid for developing a golf swing of a golfer is described. The golf training aid has a shoulder strap adapted to be worn by the golfer around the shoulder of one arm, and an elbow member adapted to be worn above the elbow of the opposite arm. When worn, a portion of the shoulder strap passes in front of the golfer where a coupling structure couples the shoulder strap to the elbow member such that the arms are positioned in front of the golfer's body. The golf training aid is adapted to maintain a substantially constant distance between the shoulder and the elbow of opposite arms during a golf swing, thus facilitating synchronization of proper arm positioning with rotation of the body throughout the golf swing.

Typically, the shoulder strap and elbow member are adjustable, and the coupling structure permits decoupling of the shoulder strap and elbow member. The decoupling or "breakaway" feature of the present invention promotes efficient use of the device by providing body/arm-positioning feedback to the golfer while promoting muscle memory.

The golf training aid of the present invention is used by: providing the golf training aid as described herein, placing the shoulder strap around the shoulder, placing the elbow member above the elbow of the opposite arm, and executing a golf swing. The shoulder strap, elbow member, and coupling structure are adapted to maintain a substantially constant distance between the shoulder and opposite elbow during the golf swing. Typically, the swing is executed with a golf club, but the golf training aid may also be used during swinging without a golf club.

The present invention thus provides a golf training aid for developing a golf swing of a golfer that is adapted to maintain a substantially constant distance between the shoulder and elbow of opposite arms during a golf swing, that is simple and effective in promoting "muscle memory," and is more efficient than known devices.

DETAILED DESCRIPTION

The present invention describes a golf training aid for developing a golf swing of a golfer that is adapted to maintain a substantially constant distance between the shoulder and elbow of opposite arms during a golf swing, that is simple and effective in promoting "muscle memory" and is more efficient than known devices.

Figures 1, 1B:
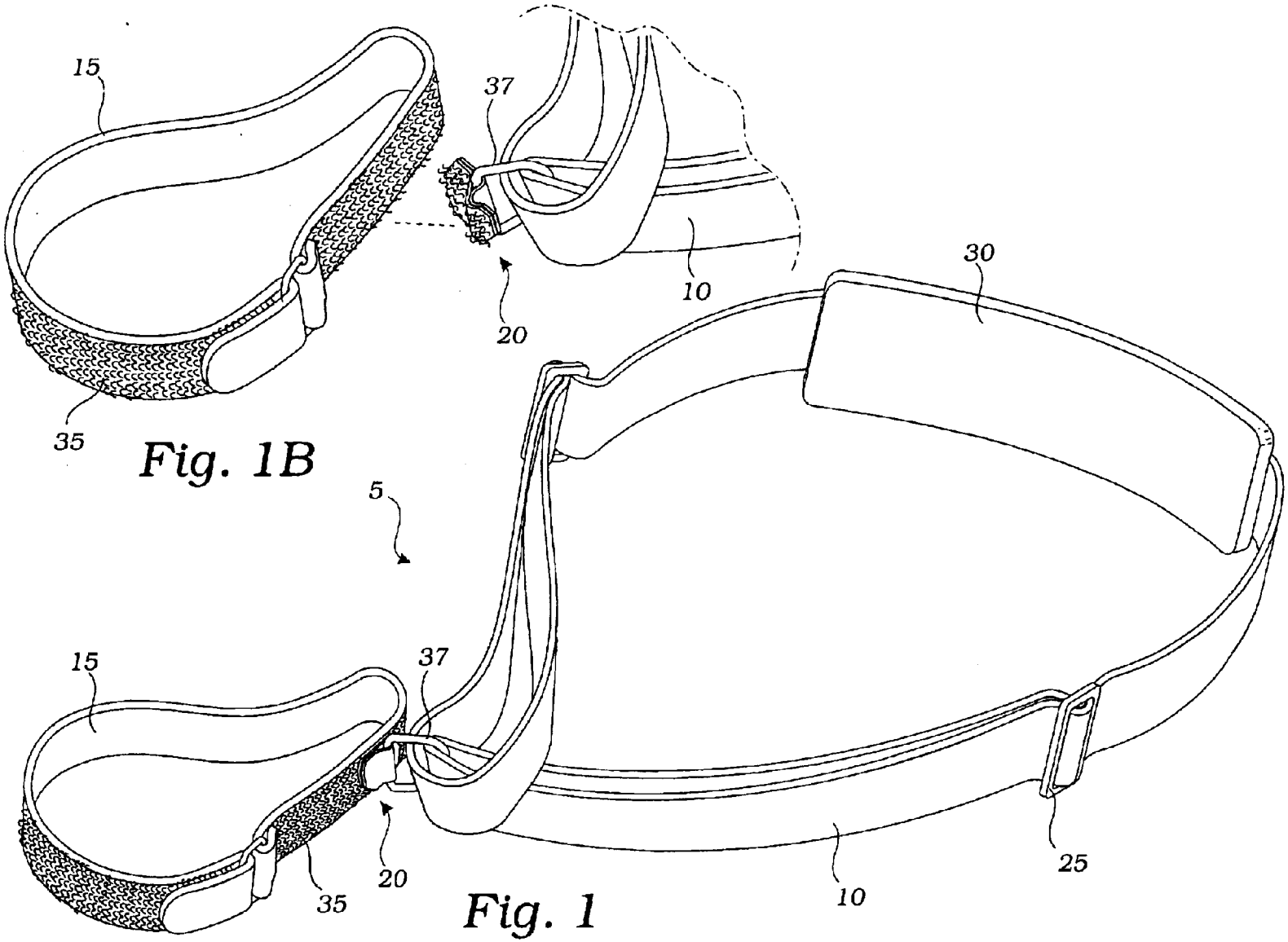
FIG. 1 is a perspective view of one embodiment of a golf training aid in accordance with the present invention, showing the shoulder strap coupled to the elbow member.
FIG. 1B is a perspective view of the golf training aid of FIG. 1, showing the shoulder strap decoupled from the elbow member.

Referring to FIG. 1, a perspective view of one embodiment of a golf training aid in accordance with the present invention is shown. The golf training aid 5 includes a shoulder strap 10, an elbow member 15, and a coupling structure 20.

Figure 2:
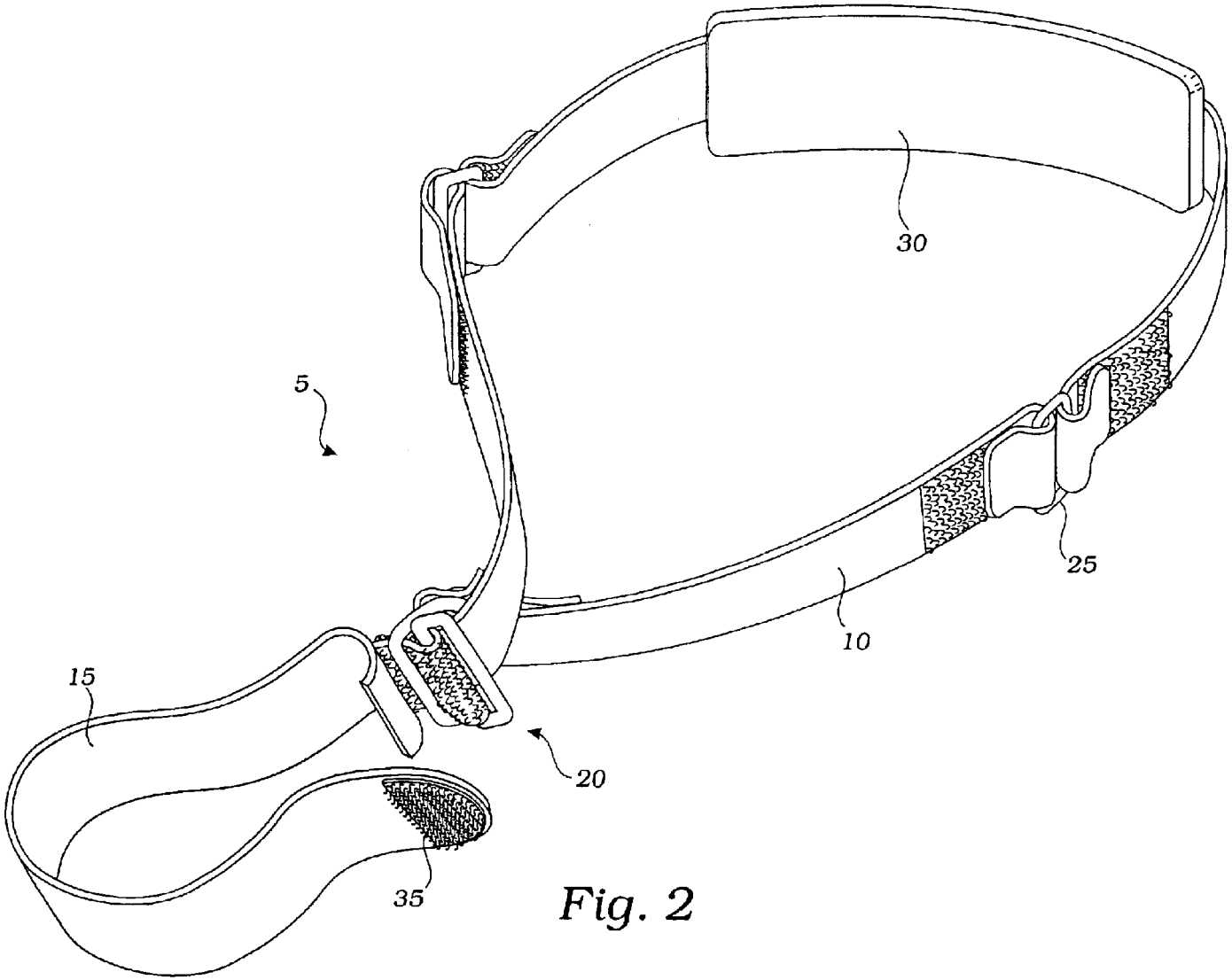
FIG. 2 is a perspective view of another embodiment of a golf training aid in accordance with the present invention.
Figure 3:
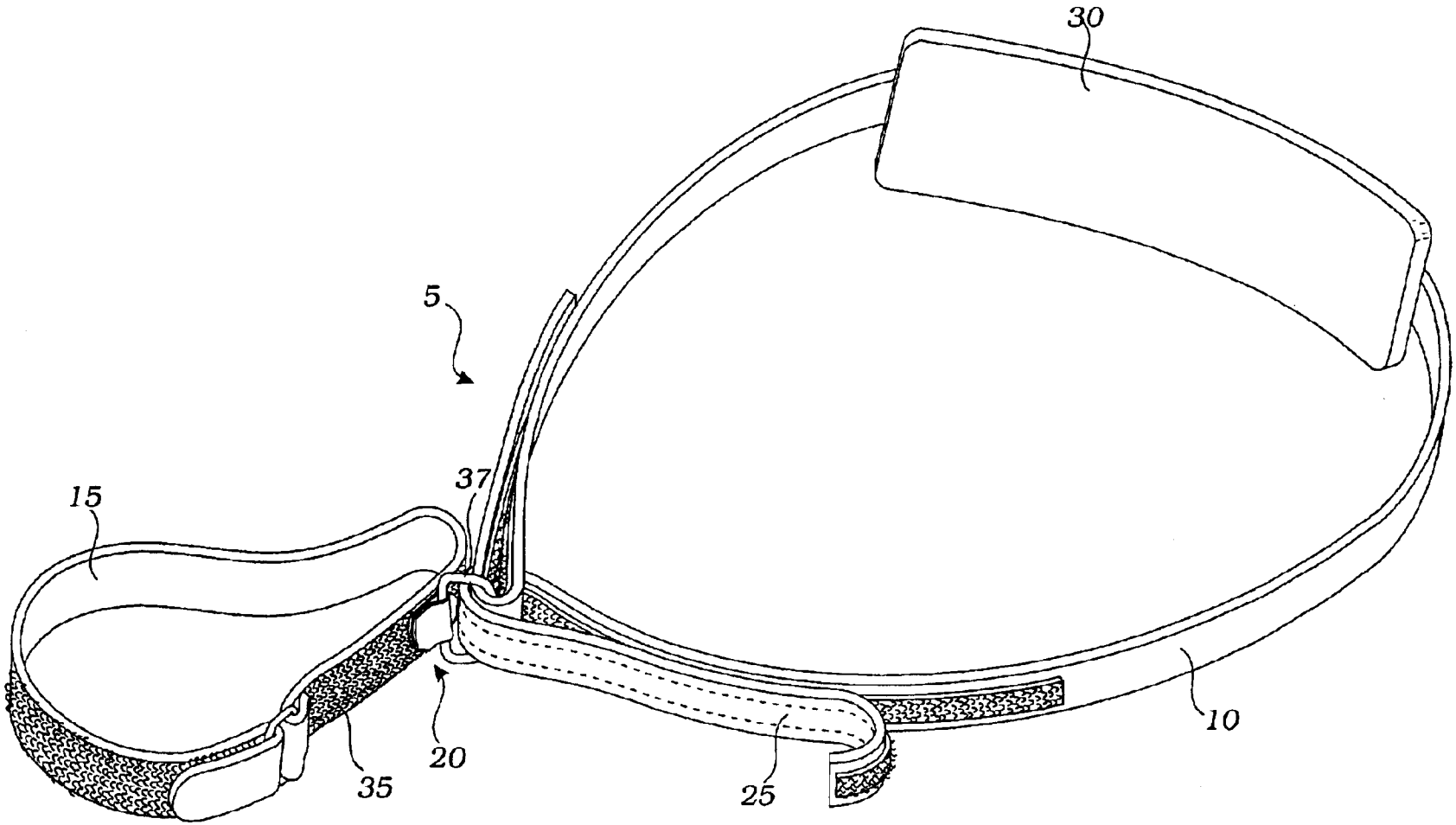
FIG. 3 is a perspective view of still another embodiment of a golf training aid in accordance with the present invention.

The shoulder strap 10 is adapted to be worn by the golfer around the shoulder of one arm. For right-handed golfers, the shoulder strap 10 is worn around the golfer's left shoulder, and for left-handed golfers, the shoulder strap 10 is worn around the golfer's right shoulder. Typically, the shoulder strap 10 is adjustable to accommodate different body types. Adjustment of the shoulder strap 10 may be facilitated by a buckle(s) 25. Alternatively, adjustment of the shoulder strap 10 may be facilitated by snap(s), VELCRO 26 (as shown in FIG. 2 and FIG. 3), or other device that permits shortening and/or lengthening of the shoulder strap 10. For comfort, a pad go or cushion may also be included on the shoulder strap 10. Typically, the golf training aid 5 is constructed of neoprene, nylon, elastic, leather or similar material.

The elbow member 15 is adapted to be worn by the golfer above the elbow of the arm opposite to the arm around which the shoulder strap 10 is placed. For example, a right-handed golfer will place the shoulder strap 10 around the golfer's left shoulder, and the elbow member 15 on the golfer's right arm. For a left-handed golfer, the shoulder strap 10 is placed around the golfer's right shoulder, and the elbow member 15 on the golfer's left arm. Preferably, the elbow member 15 is placed just above the elbow joint, i.e., closer to the elbow joint than the shoulder, thus allowing the elbow joint to move freely while positioning the arm in front of the golfer's body. Alternatively, the elbow member 15 may be worn at any position between the elbow joint and shoulder. Typically, the elbow member 15 is adjustable to accommodate different body types. Adjustment of the elbow member 15 is typically facilitated by a VELCRO 35 closure. Adjustment and/or closure of items or materials through the use of VELCRO 35 are well known in the art.

The coupling structure 20 couples the shoulder strap 10 to the elbow member 15. Preferably, the coupling structure 20 also permits the shoulder strap 10 to be decoupled from the elbow member 15. Typically, coupling/decoupling of the shoulder strap 10 to/from the elbow member 15 is facilitated by the use of VELCRO 35, and a clasp or ring type device 37 facilitates attachment of the coupling structure 20 to the shoulder strap 10. Coupling and/or decoupling of items or materials through the use of VELCRO 35 is well known in the art. Alternatively, a ball and socket device, generally constructed of plastic and similar to the type commonly used for playing flag football, may be used as a coupling/decoupling method.

Decoupling of the shoulder strap 10 from the elbow member 15 promotes efficient use of the golf training aid 5, as described herein. Improvement in swing mechanics is one specific component in which "muscle memory" is of particular importance. If the body can feel the proper golf swing positions on a more consistent basis, eventually the body adapts and the correct golf swing positions become more natural and instinctive, i.e., "muscle memory" is promoted. Allowing the body to feel the proper golf swing positions often involves placing the golfer's body into a proper golf swing position corresponding to some golf skill, and restraining the golfer's body in such a position during which time the golfer practices the required golf skill.

For example, one such golf skill requires a right-handed golfer to keep the right arm/elbow in front of the body during a "full golf swing" thus preventing the arms from "lagging" behind the body during the golf swing. Synchronization of proper arm position, i.e., maintaining the relationship between the left shoulder and the right elbow, with rotation of the body throughout the golf swing, is a fundamental skill that generally helps improve distance, accuracy, and consistency.

When worn, a portion of the shoulder strap 10 is positioned in front of the golfer near the point at which the coupling/decoupling structure 20 couples the shoulder strap 10 to the elbow member 15, such that the arms are positioned in front of the golfer's body. Thus, the golf training aid 5 places the golfer's arms in a proper position to begin execution of a golf swing. In doing so, as described herein, the golf training aid 5 is adapted to maintain a substantially constant distance between the shoulder and the elbow of opposite arms during the golf swing, thus facilitating synchronization of proper arm position with rotation of the body throughout the golf swing. With continued use, the golf training aid 5 promotes "muscle memory."

If the golfer's body/arm positioning, becomes exaggerated because the golfer fails to use sufficient muscle control enough pressure will be exerted upon the golf training aid 5 to decouple the coupling structure 20, i.e., distance "x" no longer remains substantially constant. The golfer would then know his or her swing must be adjusted. In this manner, the golf training aid 5 forces the golfer to focus on working his/her arms/body correctly during the golf swing. In other words, the golf training aid 5 provides immediate feedback (decoupling) when the golfer's arms and/or body deviate from the ideal golf swing positions, i.e., maintaining distance "x" as described herein. Thus, decoupling of the shoulder strap 10 from the elbow member 15 is simple and effective in promoting "muscle memory" and is more efficient than known golf training aids in which no body/arm positioning feedback is provided to the golfer.

In addition to providing positional feedback, the coupling/decoupling structure 20 facilitates reverse resistance, which further promotes "muscle memory." Reverse resistance may be defined as the muscle force provided by the golfer that tends to oppose a relaxed muscle state of the golfer, thus prohibiting decoupling of the coupling/decoupling structure 20. For example, the golfer, while wearing the golf training aid 5, must exert a certain degree of muscle control to maintain proper body positioning throughout the golf swing. The direction of muscle control force, which properly positions the arms, is opposite, i.e., reverse resistance, to the direction of relaxed muscle force, which, if sufficient, would decouple the coupling/decoupling structure 20. Through continued use of the golf training aid, "muscle memory" is developed as the golfer utilizes the proper golf position on a more consistent basis.

The combination of positional feedback and reverse resistance expedites swing improvement through muscle memory development, thus improving swing dynamics (including body/arm positioning), coordination/synchronization of body/arm mechanics, and power.

Conversely, if the golfer is physically unable to exhibit enough muscle control to keep the shoulder strap and elbow member coupled during the golf swing, the golf training aid 5 may be altered in order to neutralize the decoupling feature (as shown in FIG. 2). Although this eliminates the reverse resistance feature of golf training aid 5, it still maintains the same shoulder/opposite elbow relationship throughout the golf swing. The arms and body will reach the same swing positions as in the first embodiment (with the decoupling feature), thus giving the golfer positional feedback and promoting "muscle memory." With practice, the golfer will develop enough flexibility and strength to eventually be able to practice the golf swing with the coupling/decoupling structure 20 in tact.

Figure 4:
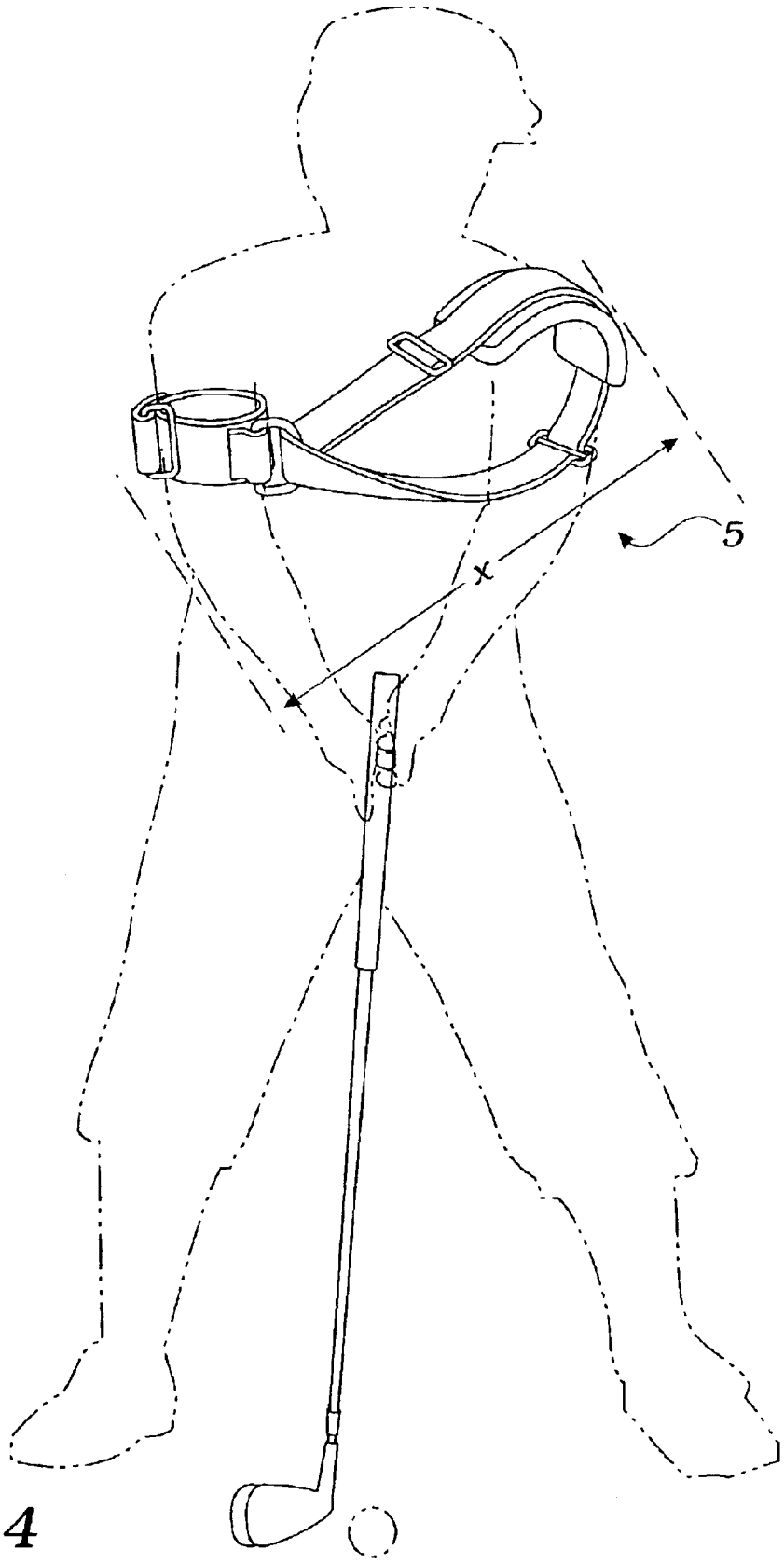
FIG. 4 illustrates the golf training aid of FIG. 1 being used by a golfer with golf club while addressing a golf ball, showing a substantially constant distance "x" maintained by the present invention.
Figure 5:
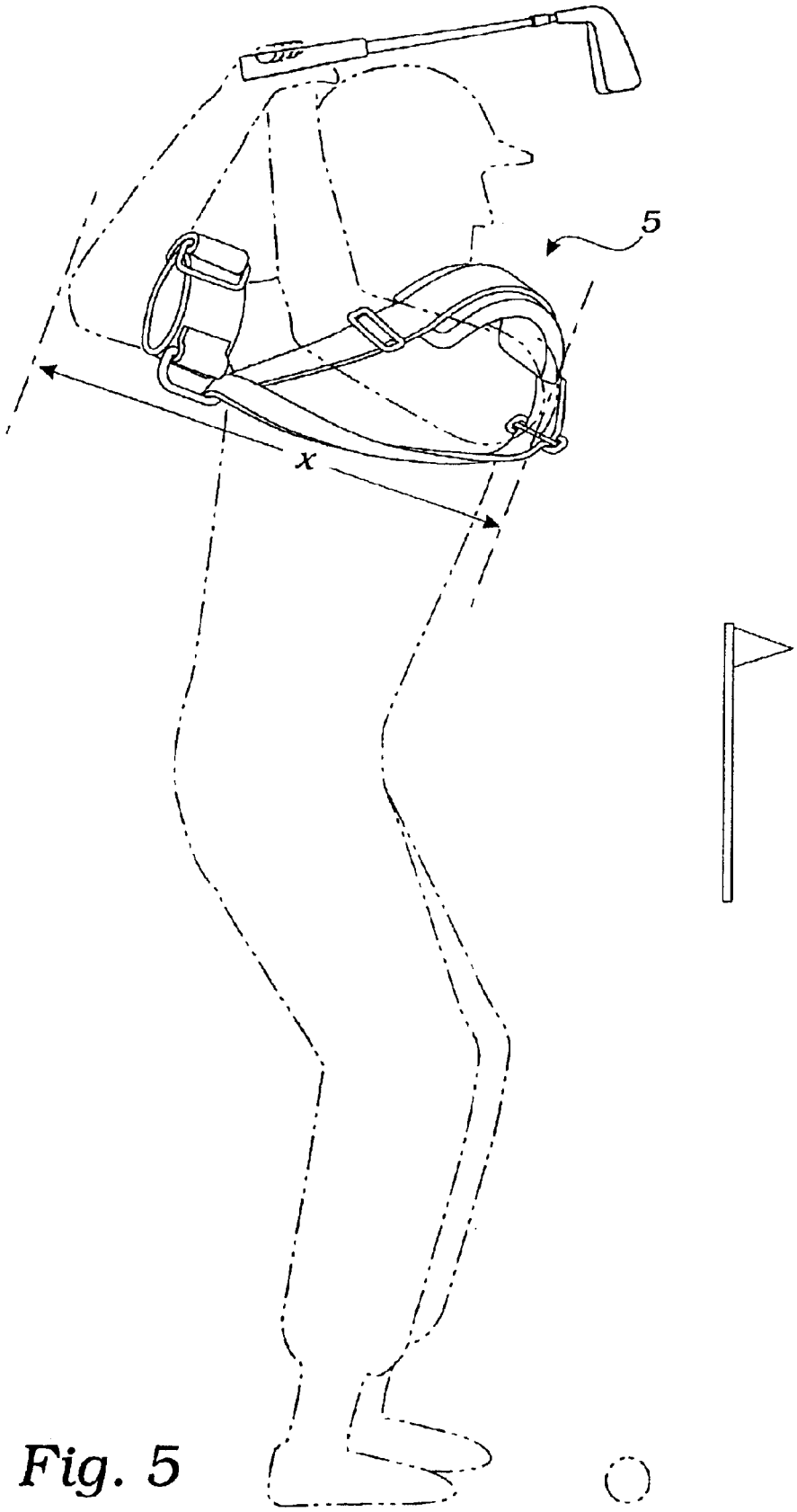
FIG. 5 illustrates the golf training aid of FIG. 1, being used by a golfer during a golf club backswing, showing the substantially constant distance "x" maintained by the present invention.
Figure 6:
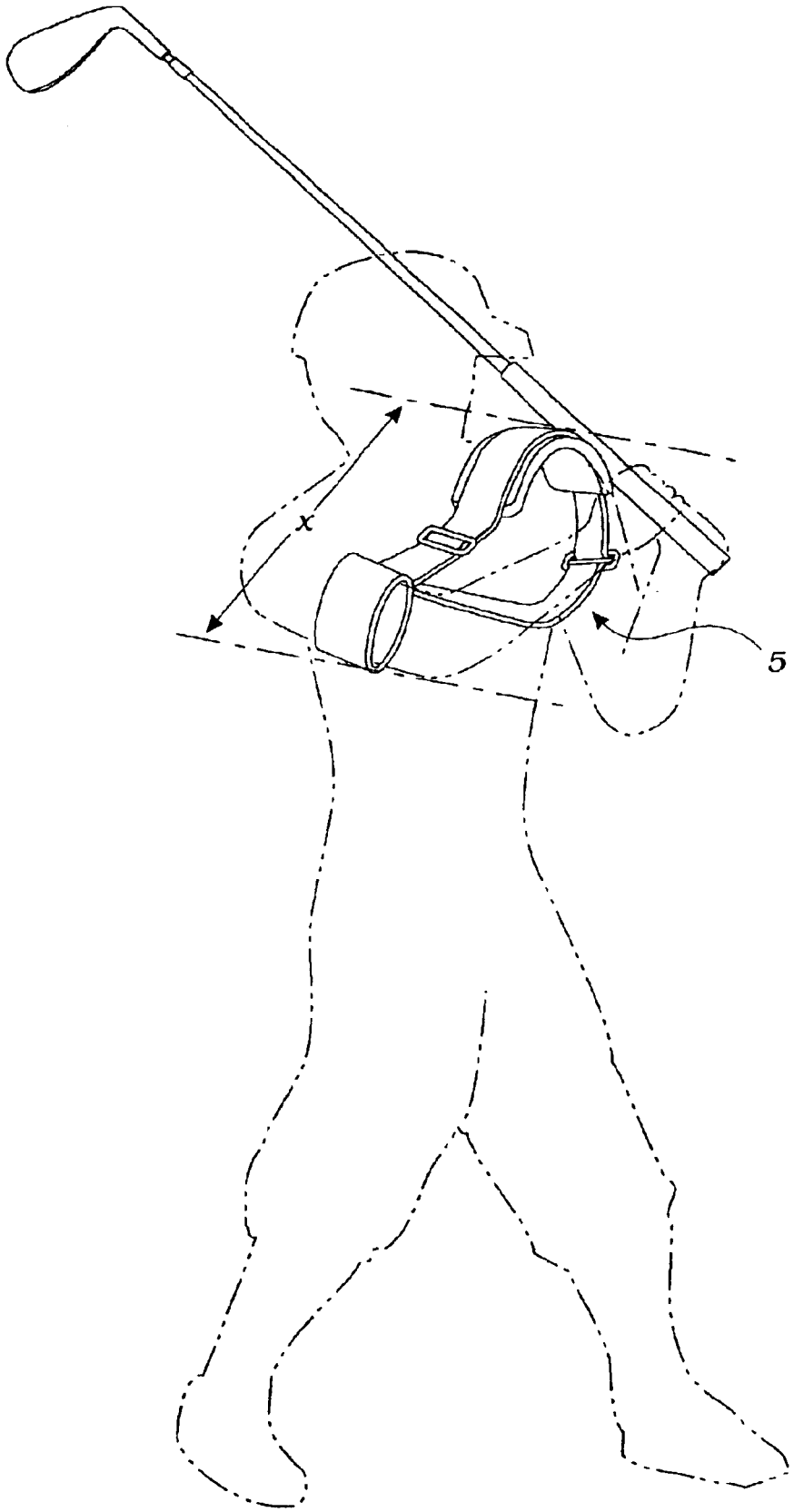
FIG. 6 illustrates the golf training aid of FIG. 1, being used by a golfer during a golf club follow-through, showing the substantially constant distance "x" maintained by the present invention.

The shoulder strap 10, elbow member 15, and the coupling structure 20 are adapted to maintain a substantially constant distance, represented in the drawings by "x," between the shoulder and the opposite elbow during a golf swing, as shown in FIGS. 4–6. As used herein, distance "x" is one component, measured in units of distance, of a relationship that exists between the shoulder and elbow of opposite arms during the execution of a golf swing, and is determined by a number of variables particular to each golfer. One such variable may include the body type of the golfer. For example, a heavy golfer with thick arms and a wide back may have a distance "x" that is greater than distance "x" for a skinny golfer with thin arms and a narrow back. Thus, distance "x" is not defined as any single distance, but once established for a particular golfer, the golf training aid 5 (i.e., the shoulder strap 10, elbow member 15, and coupling structure 20), maintain a substantially constant distance between the shoulder and elbow of opposite arms throughout the execution of a "full golf swing." Establishing the distance between the shoulder and opposite elbow may be accomplished by a manufacturer and/or by individual adjustment. Through various adjustments, as described herein, the golf training aid 5 is easily and quickly adjusted to establish the proper distance between the shoulder and opposite elbow, as shown in FIG. 4. Once established, the material construction of the golf training aid 5 maintains a substantially constant distance.

After initial establishment of distance "x," slight variations in distance "x" will typically occur due to the inherent properties of various materials used in the construction of the golf training aid 5, as well as variations in golfer body types. For example, a shoulder strap 10 constructed of neoprene will typically stretch a greater degree when compared to the degree of stretch in a shoulder strap 10 constructed of leather. Therefore, although various factors affect distance "x" throughout the execution of a golf swing, the golf training aid 5 is capable of maintaining a substantially constant distance "x," to the degree necessary for the golfer to derive the intended benefits of the golf training aid 5. Distance "x" is maintained from initial address (as shown in FIG. 3), throughout the backswing (as shown in FIG. 5) and downswing, until completion/follow-through of a "full golf swing" (as shown in FIG. 6).

Maintaining a substantially constant distance "x" between the shoulder and elbow of opposite arms promotes correct body/arm positioning by keeping the arms in front of the body throughout the golf swing. Thus, allowing the arms and body to work together. In addition, the golf training aid 5 reinforces the correct arm/body position at the top of the swing, providing a reference point from which to start the downswing, as shown in FIG. 5.

Figure 7:
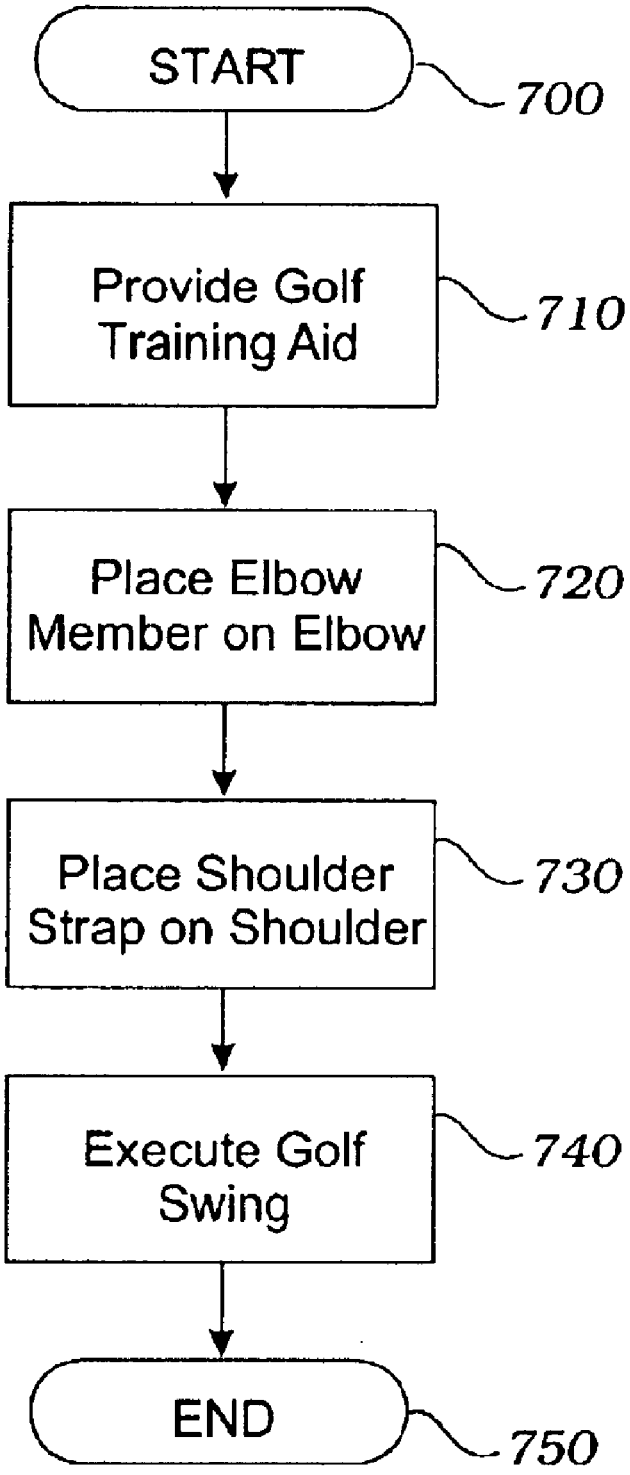
FIG. 7 is a flow chart illustrating a method of developing a golf swing of a golfer in accordance with the present invention.

Turning now to FIG. 7, a flow chart illustrating a method of developing a golf swing of a golfer in accordance with the present invention is shown. The process starts at step 700. At step 710, a golf training aid as described herein is provided. A manufacturer, distributor, or other third party may supply the device. In this respect, "providing" the device is intended to refer to the fact that such a device is in fact present in use with the method, and so the device may also be provided by the actual user thereof.

At step 720, the elbow member 15 is placed above the elbow of the arm. The elbow member 15 is adapted to be worn by the golfer above the elbow of the arm opposite to the arm around which the shoulder strap 10 is placed. For example, a right-handed golfer will typically place the shoulder strap 10 around the left shoulder, and the elbow member 15 on the right arm. For a left-handed golfer, the shoulder strap 10 is typically placed on the right shoulder, and the elbow member 15 on the left arm.

Placement of the elbow member 15 is generally facilitated by an adjustment means such as VELCRO, elastic or other stretchable material. Similar to the shoulder strap 10, the elbow member 15 may be fastened prior to placement above the elbow joint such that the golfer's hand and elbow joint are slipped through the elbow member 15. Alternatively, the elbow member 15 may be fastened around the upper arm after placement above the elbow joint.

Preferably, the elbow member 15 is located near the elbow joint around the bicep, i.e., closer to the elbow joint than the shoulder, thus allowing the elbow joint to move freely while positioning the arm in front of the golfer's body. Alternatively, depending on the golfer's body type and comfort level, the elbow member 15 may be worn at any position between the elbow joint and shoulder.

At step 730, the shoulder strap 10 is placed around the shoulder of the opposite arm. Typically, as described herein, which arm the shoulder strap 10 is placed around is dependent on whether the golfer is a right-handed or a left-handed golfer. Typically, placement of the shoulder strap 10 around the shoulder of one arm requires the golfer to place a hand through a preformed loop formed by the shoulder strap 10, or by the shoulder strap 10 in connection with the coupling. structure 20. Alternatively, the shoulder strap 10 may be looped around the shoulder of one arm, and then connected to the coupling structure 20. When properly placed, a portion of the shoulder strap 10 is positioned in front of the golfer and a portion of the shoulder strap 10 is positioned behind the golfer, i.e., the shoulder strap 10 is around the shoulder.

At step 740, a golf swing is executed. Typically, a "full golf swing" is executed as shown in FIGS. 4–6. FIG. 4 illustrates a golfer with a golf club addressing the golf ball; FIG. 5 illustrates the golfer with a golf club during a backswing; and FIG. 6 illustrates a follow-through of the golfer after hitting the golf ball. The method ends at step 50.

While certain embodiments are illustrated in the drawings and are described herein, it will be apparent to those skilled in the art that the specific embodiments described herein may be modified without departing from the inventive concepts described. For example, though the processes of the present invention are illustrated herein with steps occurring in certain orders, the specific order of the steps is not required. For example, placement of the shoulder strap around the shoulder, step 730, may occur prior to placing the elbow member near the elbow of the opposite arm, at step 720.

What is claimed is:

1. A method of developing a golf swing of a golfer comprising the steps:

providing a golf training aid comprising: a shoulder strap, an elbow member, and a coupling structure coupling said shoulder strap to said elbow member;

placing said elbow member above the elbow of the one arm;

placing said shoulder strap around the shoulder of the opposite arm; and executing a golf swing;

wherein said shoulder strap, said elbow member, and said coupling structure arm configured to maintain a substantially constant distance between the shoulder and the elbow during the golf swing;

wherein said shoulder strap, elbow member and coupling structure are not coupled to any element which is configured to be coupled to the torso of the golfer; and wherein said elbow member, said coupling structure, and a portion of said shoulder strap are in font of the golfer.

2. The method of claim 1, further comprising the step of providing a golf club and wherein the golf swing is executed with said golf club.

3. The method of claim 1, wherein said shoulder strap is adjustable.

4. The method of claim 3, wherein said shoulder strap comprises an adjustment device having a book and loop fastener which adjusts the length of said shoulder strap.

5. The method of claim 1, wherein said elbow member is adjustable.

6. The method of claim 5, wherein said elbow member comprises an adjustment device having a hook and loop fastener which adjusts the size of said elbow member.

7. The method of claim 1, wherein said coupling structure permits decoupling of said shoulder strap and said elbow member during the golf swing.

8. The method of claim 7, wherein said shoulder slap and elbow member comprise a book and loop fastener which permits the decoupling of said shoulder strap from said elbow member.

* * * * *